United States Patent [19]

Binversie et al.

[11] Patent Number: 5,005,535

[45] Date of Patent: Apr. 9, 1991

[54] INTERNAL COMBUSTION ENGINE WITH RECESSED INTAKE MANIFOLD

[75] Inventors: Gregory J. Binversie, Grayslake; James E. Macier, Beach Park; David W. Mate, McHenry, all of Ill.

[73] Assignee: Outboard Marine Corporation, Waukegan, Ill.

[21] Appl. No.: 482,932

[22] Filed: Feb. 20, 1990

Related U.S. Application Data

[63] Continuation-in-part of Ser. No. 316,319, Feb. 27, 1989, abandoned.

[51] Int. Cl.[5] ..... F02M 35/10

[52] U.S. Cl. ..... 123/52 M; 123/73 A

[58] Field of Search ..... 123/52 MC, 52 MB, 73 A, 123/73 PP, 73 SC, 52 M, 73 V, 73 R, 65 R, 179 G, 179 SE, 180 R

[56] References Cited

U.S. PATENT DOCUMENTS

| | | | |
|---|---|---|---|
| 3,453,994 | 7/1969 | Nutten et al. | 123/73 R |
| 3,800,753 | 4/1974 | Sullivan et al. | 123/73 A |
| 4,286,553 | 9/1981 | Baltz et al. | 123/73 PP |
| 4,445,468 | 5/1984 | Onishi et al. | 123/73 C |
| 4,462,346 | 7/1984 | Haman et al. | 123/73 A |
| 4,757,792 | 7/1988 | Flaig et al. | 123/437 |
| 4,770,132 | 9/1988 | Sougawa | 123/73 A |
| 4,776,313 | 10/1988 | Freismuth et al. | 123/470 |
| 4,777,913 | 10/1988 | Staerzl et al. | 123/73 A |
| 4,825,821 | 5/1989 | Baltz et al. | 123/73 A |
| 4,867,109 | 9/1989 | Tezuka et al. | 123/52 MB |
| 4,917,053 | 4/1990 | Okazaki | 123/52 MB |

FOREIGN PATENT DOCUMENTS 2758492 7/1978 Fed. Rep. of Germany ... 123/73 A

*Primary Examiner*—Willis R. Wolfe
*Assistant Examiner*—Thomas N. Moulis
*Attorney, Agent, or Firm*—Michael, Best & Friedrich

[57] ABSTRACT

An internal combustion engine comprising an engine member including an intake manifold mounting face having therein a series of openings, an intake manifold including an exterior surface comprising an engine mounting surface on the manifold mounting face, and a carburetor mounting surface in spaced relation to the engine mounting surface, and a like series of intake passages extending between the mounting surfaces, terminating at the engine mounting surface in respective openings respectively located in alignment with the openings in the manifold mounting face, and terminating at the carburetor mounting surface in respective openings, a drain re-circulation system for delivering drains accumulating in the intake passages to intake passages other than the intake passages in which the drains accumulated, a system for supplying primer fuel to the intake passages, and a system for supplying operating fuel to a like series of carburetors, and a like series of carburetors on the carburetor mounting surface, which carburetors respectively include air induction passages respectively communicating with the openings in the carburetor mounting surface, and respective fuel inlet ports respectively communicating with the operating fuel supply system in the intake manifold.

66 Claims, 4 Drawing Sheets

INTERNAL COMBUSTION ENGINE WITH RECESSED INTAKE MANIFOLD

RELATED APPLICATION;

This is a continuation-in-part of Ser. No. 316,319, filed Feb. 27, 1989, now abandoned.

BACKGROUND OF THE INVENTION

The invention relates generally to the internal combustion engines and more particularly to two stroke internal combustion engines wherein lubricant is supplied with the fuel in a fuel/lubricant mixture.

More particularly, the invention relates to fuel supply systems, to primer fuel supply systems, and to drain re-circulation or delivery systems for two stroke internal combustion engines.

The invention also relates to the manufacture of internal combustion engines and to minimization of cost of manufacturing of such internal combustion engines.

Attention is directed to the following U.S. Pat. Nos.:
Sullivan, et al. 3,800,753, Apr. 2, 1974
Haman, et al. 4,412,346, July 31, 1984
Flaig, et al. 4,757,792, July 12, 1988
Baltz, et al. 4,825,821, May 2, 1989

SUMMARY OF THE INVENTION

The invention provides an internal combustion engine comprising an engine member including an intake manifold mounting face having therein a series of openings, an intake manifold including an engine mounting surface on said manifold mounting face, a carburetor mounting surface in spaced relation to said engine mounting surface, a like series of intake passages extending between the mounting surfaces, terminating at the engine mounting surface in respective openings respectively located in alignment with the openings in the manifold mounting face, and terminating at the carburetor mounting surface in respective openings, and drains re-circulation means for delivering drains accumulating in the intake passages to intake passages other than the intake passages in which the drains accumulated, and a like series of carburetors on the carburetor mounting surface, which carburetors respectively include air induction passages communicating respectively with the openings in the carburetor mounting surface.

The invention also provides an internal combustion engine comprising an engine member including an intake manifold mounting face having therein an opening, an intake manifold including an exterior surface comprising an engine mounting surface on the manifold mounting face, and a carburetor mounting surface in spaced relation to the engine mounting surface, an intake passage extending between the mounting surfaces, terminating at the engine mounting surface in an opening located in alignment with the opening in the manifold mounting face, and terminating at the carburetor mounting surface in an opening, and means for supplying primer fuel to the intake passage and comprising a primer fuel duct located in one of the mounting surfaces, and a carburetor located on the carburetor mounting surface and including an air induction passage communicating with the opening in the carburetor mounting surface.

The invention also provides an internal combustion engine comprising an engine member including an intake manifold mounting face having therein an opening, an intake manifold including an exterior surface comprising an engine mounting surface on the manifold mounting face, and a carburetor mounting surface in spaced relation to the engine mounting surface, and an intake passage extending between the mounting surfaces, terminating at the engine mounting surface in an opening located in alignment with the opening in the manifold mounting face, and terminating at the carburetor mounting surface in an opening, and means for supplying operating fuel to a carburetor, and a carburetor located on the carburetor mounting surface and including an air induction passage communicating with the opening in the carburetor mounting surface and a fuel inlet port communicating with the operating fuel supply means in the intake manifold.

The invention also provides an internal combustion engine comprising an engine member including an intake manifold mounting face having therein a series of openings, an intake manifold including an exterior surface comprising an engine mounting surface on the manifold mounting face, and a carburetor mounting surface in spaced relation to the engine mounting surface, a like series of intake passages extending between the mounting surfaces, terminating at the engine mounting surface in respective openings respectively located in alignment with the openings in the manifold mounting face, and terminating at the carburetor mounting surface in respective openings, drain re-circulation means for delivering drains accumulating in said intake passages to intake passages other than the intake passages in which the drains accumulated, and means for supplying primer fuel to the intake passages, and a like series of carburetors on the carburetor mounting surface, which carburetors respectively include air induction passages communicating respectively with the openings in the carburetor mounting surface.

The invention also provides an internal combustion engine comprising an engine member including an intake manifold mounting face having therein a series of openings, an intake manifold including an exterior surface comprising an engine mounting surface on the manifold mounting face, and a carburetor mounting surface in spaced relation to the engine mounting surface, a like series of intake passages extending between the mounting surfaces, terminating at the engine mounting surface in respective openings respectively located in alignment with the openings in the manifold mounting face, and terminating at the carburetor mounting surface in respective openings, drains re-circulation means for delivering drains accumulating in the intake passages to intake passages other than the intake passages in which the drains accumulated, and means for supplying operating fuel to a like series of carburetors, and a like series of carburetors on the carburetor mounting surface, which carburetors include respective air induction passages respectively communicating with the openings in the carburetor mounting surface and respective fuel inlet ports respectively communicating with the operating fuel supply means in the intake manifold.

The invention also provides an internal combustion engine comprising an engine member including an intake manifold mounting face having therein a series of openings, an intake manifold including an exterior surface comprising an engine mounting surface on the manifold mounting face, and a carburetor mounting surface in spaced relation to the engine mounting surface, a like series of intake passages extending between said mounting surfaces, terminating at the engine mounting surface in respective openings respectively located in alignment with the openings in the manifold mounting face, and terminating at said carburetor mounting surface in respective openings, drains re-circulation means for delivering drains accumulating in the intake passages to intake passages other than the intake passages in which the drains accumulated, means for supplying primer fuel to the intake passages, and means for supplying operating fuel to a like series of carburetors, and a like series of carburetors on the carburetor mounting surface, which carburetors include respective air induction passages communicating respectively with the openings in the carburetor mounting surface, and respective fuel inlet ports respectively communicating with the operating fuel supply means in the intake manifold.

The invention also provides an internal combustion engine comprising an engine block including an intake manifold mounting face having therein a series of rectangular openings, an intake manifold including an exterior surface comprising an engine mounting surface on the intake manifold mounting face, and a carburetor mounting surface in spaced parallel relation to the engine mounting surface, a like series of intake passages extending between the mounting surfaces, terminating at the engine mounting surface in respective rectangular openings respectively located in alignment with the openings in the manifold mounting face and having respective lower ends, and terminating at the carburetor mounting surface with respective circular openings, means for supplying operating fuel and including a like series of fuel supply recesses located in the carburetor mounting surface, and a like series of fuel supply conduits respectively communicating between the fuel supply recesses and the exterior surface, means for supplying primer fuel and comprising a primer fuel inlet port located in the exterior surface and adapted to communicate with a source of primer fuel, a common recess located in the engine mounting surface and communicating with the primer fuel inlet port, a like series of primer fuel cross bores extending between the mounting surfaces and communicating with the common recess, and a like series of duct defining recesses located in the carburetor mounting surface and respectively communicating with the primer fuel cross bores and with the openings in the carburetor mounting surface, and drains re-circulation means comprising a like series of sump defining recesses in the engine mounting surface, a like series of duct defining recesses in the engine mounting surface and respectively communicating between the sump defining recesses and the lower ends of the openings in the engine block mounting surface, a first like series of cross bores extending between the mounting surfaces and respectively communicating with the series of sump defining recesses, a first like series of duct defining recesses in the carburetor mounting surface and respectively communicating with the first series of cross bores, a second like series of cross bores extending between the mounting surfaces and respectively communicating with the first like series of duct defining recesses in the carburetor mounting surface, a second like series of duct defining recesses extending in the engine mounting surface and respectively communicating with the second like series of cross bores, a third like series of cross bores extending between the mounting surfaces and respectively communicating with the second like series of duct defining recesses in the engine mounting surface, and a second like series of duct defining recesses in the carburetor mounting surface and respectively communicating between the third like series of cross bores and the circular openings in the carburetor mounting surface, an operating fuel supply header exterior to the intake manifold and including a like series of branch conduit portions respectively communicating with the fuel supply conduits, and a common portion communicating with the branch portions and having therein a fuel filter and being adapted to communicate with a source of operating fuel, a like series of carburetors located on the carburetor mounting surface and including respective air induction passages respectively located in communication with the circular openings in the carburetor mounting surface, and respective fuel inlet ports respectively locate in communication with the fuel supply recesses, means fastening the intake manifold to the engine block, and means securing the carburetor on the intake manifold including fasteners extending through the intake manifold and into the engine block.

The invention also provides an intake manifold including an engine mounting surface, a carburetor mounting surface in spaced relation to the engine mounting surface, a series of intake passages extending between the mounting surfaces, terminating at the engine mounting surface in respective openings, and terminating at the carburetor mounting surface in respective openings, and drains re-circulation means for delivering drains accumulating in the intake passages to intake passages other than the intake passages in which the drains accumulated.

The invention also provides an intake manifold including an exterior surface comprising an engine mounting surface, and a carburetor mounting surface in spaced relation to the engine mounting surface, an intake passage extending between the mounting surfaces, terminating at the engine mounting surface in an opening, and terminating at the carburetor mounting surface in an opening, and means for supplying primer fuel to the intake passage and comprising a primer fuel duct located in one of the mounting surfaces.

The invention also provides an intake manifold including an engine mounting surface, and a carburetor mounting surface in spaced relation to the engine mounting surface, an intake passage extending between the mounting surfaces, terminating at the engine mounting surface in an opening, and terminating at the carburetor mounting surface in an opening, and means for supplying operating fuel to a carburetor.

The invention also provides an intake manifold including an exterior surface comprising an engine mounting surface, and a carburetor mounting surface in spaced relation to the engine mounting surface, a series of intake passages extending between the mounting surfaces, terminating at the engine mounting surface in respective openings, and terminating at the carburetor mounting surface in respective openings, drains re-circulation means for delivering drains accumulating in the intake passages to intake passages other than the intake passages in which the drains accumulated, and means for supplying primer fuel to the intake passages.

The invention also provides an intake manifold including an exterior surface comprising an engine mounting surface, and a carburetor mounting surface in spaced relation to the engine mounting surface, a series of intake passages extending between the mounting surfaces, terminating at the engine mounting surface in respective openings, and terminating at the carburetor mounting surface in respective openings, drains re circulation means for delivering drains accumulating in the intake passages to intake passages other than the intake passages in which the drains accumulated, and means for supplying operating fuel to a like series of carburetors.

The invention also provides an intake manifold including an exterior surface comprising an engine mounting surface, and a carburetor mounting surface in spaced relation to the engine mounting surface, a series of intake passages extending between the mounting surfaces, terminating at the engine mounting surface in respective openings, and terminating at the carburetor mounting surface in respective openings, drains re-circulation means for delivering drains accumulating in the intake passages to intake passages other than the intake passages in which the drains accumulated, means for supplying primer fuel to the intake passages, and means for supplying operating fuel to a like series of carburetors.

The invention also provides an internal combustion engine comprising an engine member including an intake manifold mounting face, an intake manifold including an engine mounting surface on the manifold mounting face, and a carburetor mounting surface in spaced parallel relation to the engine mounting surface, a carburetor on the carburetor mounting surface, means securing the carburetor to the engine member with the intake manifold captured between the engine member and the carburetor and including fasteners extending through the intake manifold and into the engine member.

The invention also provides an intake manifold including an engine mounting surface, a carburetor mounting surface in spaced relation to the engine mounting surface, an intake passage extending between the mounting surfaces, terminating at the engine mounting surface in an opening and terminating at the carburetor mounting surface in an opening, and means for draining drains accumulating in the intake passage, the means comprising a drain duct in the carburetor mounting surface, and a cross bore extending between the mounting surfaces and communicating between the opening in the engine mounting surface and the drain duct.

The invention also provides an internal combustion engine comprising an engine block including an intake manifold mounting surface and defining a cylinder and a transfer passage communicating with the cylinder, an intake manifold including an engine mounting surface mating with the intake manifold mounting surface, a carburetor mounting surface in spaced relation to the engine mounting surface, an intake passage extending between the engine mounting surface and the carburetor mounting surface, terminating at the engine mounting surface in an opening communicating with the transfer passage, and terminating at the carburetor mounting surface in an opening, and drains recirculation means comprising a drain duct located in the engine mounting surface and communicating with the opening in the engine mounting surface, and means for delivering drains from the drain duct to the transfer passage.

One of the principal features of the invention is the provision of an intake manifold which is economically manufactured from alcohol-resistant plastic or other similar composite material and which has integrally molded therein at least portions of one or more of a "drains" re-circulation system, a primer fuel supply system, and a system for supplying operating fuel to an associated carburetor(s). Integral incorporation in the intake manifold of at least portions of one or more of a drains re-circulation system, a primer fuel supply system, and an operating fuel supply system substantially economically reduces the cost of engine manufacture.

Another of the principal features of the invention involves mounting of the carburetor or carburetors directly from an engine block or other member, with an intake manifold being captured in proper position between the engine block or other member and the carburetor(s). When the intake manifold is thus associated with the engine block, it is no longer a structural member (except for possible support of light-weight reed valves) and can be fabricated of alcohol-resistant plastic or other suitable composite material.

Other features and advantages of the invention will become apparent to those skilled in the art upon review of the following detailed description, claims, and drawings.

THE DRAWINGS

Figure 7:
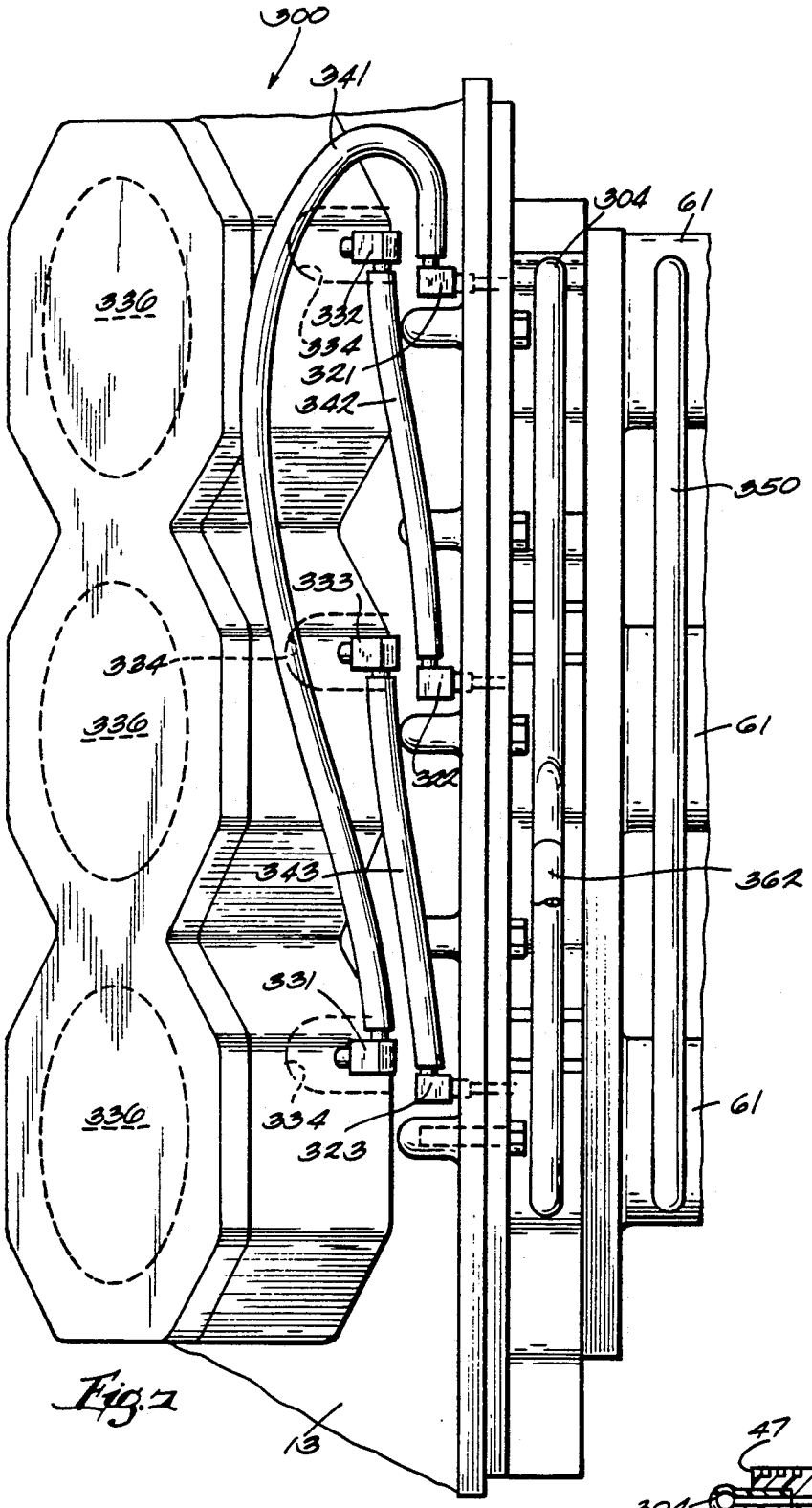
FIG. 7 is a fragmentary and partially schematic view of a two-stroke internal combustion engine that is an alternative embodiment of the invention.
Figure 11:
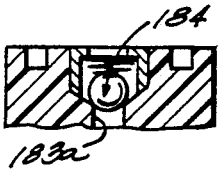
FIG. 11 is a view taken along line 11—11 in FIG. 9.
Figure 10:
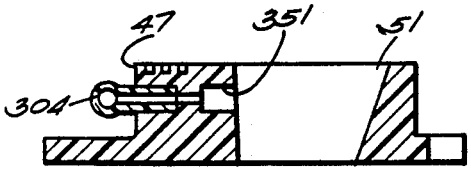
FIG. 10 is a view taken along line 10—10 in FIG. 9.
Figure 2:
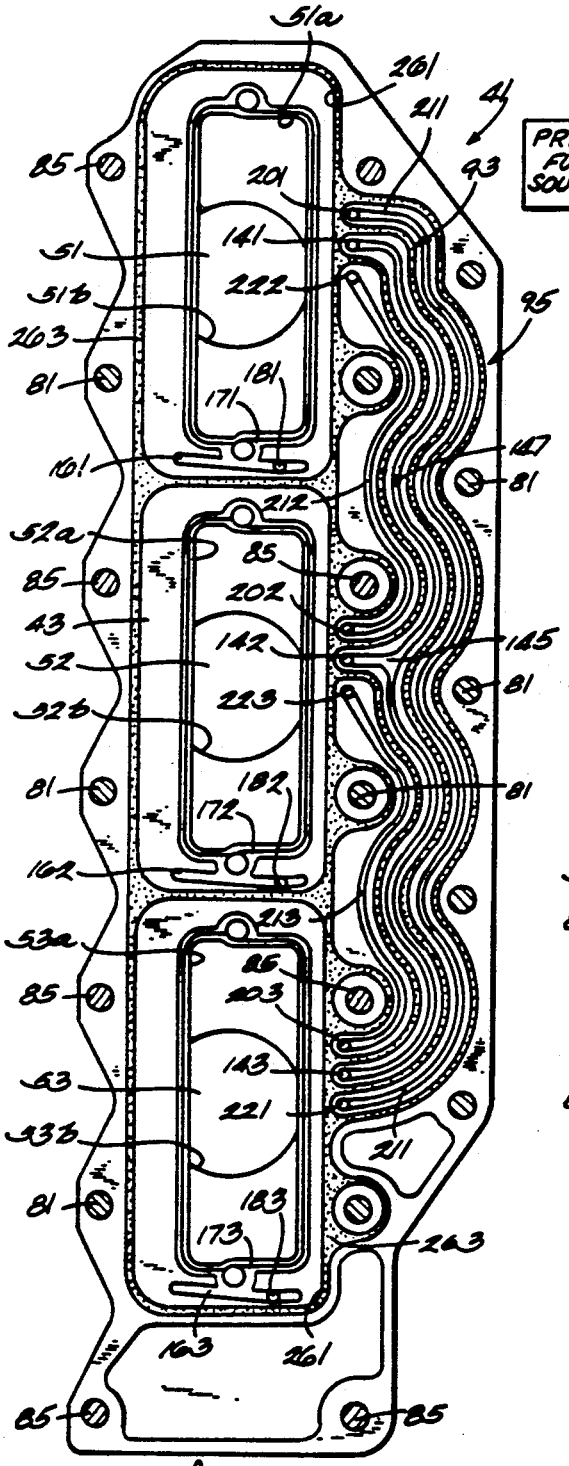
FIG. 2 is an enlarged and partially sectioned view of one side of the intake manifold incorporated in the engine shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIGS. 1–6 and 12 is a two-stroke internal combustion engine 11 which can be of any suitable construction and which includes an engine block 13 having an intake manifold mounting face 15 including (see FIG. 6) a series of generally rectangular openings 17, 18 and 19 which communicate through a like series of passages 21, 22 and 23 with a like series of crankcases (one shown in dotted outline). Located in the passages 21, 22, and 23 adjacent the rectangular openings 17, 18 and 19 are a like series of reed boxes 25 (one shown in FIG. 1). The intake manifold mounting face 15 can be either on an engine block as disclosed, for instance, in U.S. application Ser. No. 316,153, filed Feb. 27, 1989, or on an engine crankcase cover (not shown) which completes the series of crankcases and which is attached to the engine block, or on any other suitable engine member.

Mounted on the manifold mounting face 15 is an intake manifold 41 which supports the reed boxes 25 in any suitable manner and which includes an exterior surface 47 including an engine mounting surface 43 located in engagement with the manifold mounting face 15, and a carburetor mounting surface 45 in parallel and spaced relation to the engine mounting surface 43. The intake manifold 41 also includes (see FIGS. 2 and 3) a like series of intake passages 51, 52, and 53 extending in generally parallel relation between the mounting surfaces 43 and 45 and respectively communicating with the passages 21, 22 and 23 in the engine block 13. While other constructions can be employed, in the disclosed construction, the intake passages 51, 52 and 53 terminate, at the engine mounting surface 43 (see FIG. 2), in respective rectangular openings 51*a*, 52*a*, and 53*a*, each including a lower end in which "drains" tend to accumulate, and, at the carburetor mounting surface 45 (see FIG. 3), in respective circular openings 51*b*, 52*b* and 53*b*.

Mounted on the intake manifold 41 is a carburetor unit 60 including a manifold mounting face 65 located in engagement with the carburetor mounting surface 45 of the intake manifold 41. The carburetor unit 60 also includes a like series of carburetors 61 (only one shown) including respective air induction passages 71 (only one shown) respectively communicating with the intake passages 51, 52 and 53 in the intake manifold, and respective fuel supply inlet ports 76, (only one shown) located in the manifold mounting face 65. If desired, the carburetors 61 could be separate from each other and include respective manifold mounting faces.

Any suitable carburetor construction can be employed, as for instance, the construction disclosed in U.S. application Ser. No. 132,630, filed Dec. 4, 1987, which application is assigned to the assignee of this application and is incorporated herein by reference.

Means are provided for securing the intake manifold 41 to the engine block 13. While various constructions can be employed, in the disclosed construction, a series of bolts 81 (see FIGS. 1, 2 and 3) are employed to attached the intake manifold 41 to the engine block 13.

Means are also provided for securing the carburetor 60 (or the individual carburetors 61) to the intake manifold 41. While other constructions can be employed, in the disclosed construction, such means comprises (see FIGS. 1, 2 and 3) a series of bolts 85 which pass through clearance apertures 87 in the intake manifold 41 and are threaded directly into the engine block 13. Alternatively, if desired, the carburetor unit 60 (or the individual carburetors 61) could be secured to the intake manifold 41 by using a series of bolts (not shown) threaded into the intake manifold 41. As a still further alternative, the clearance of apertures 87 can be sized relative to the bolts 85 such that the bolts 81 can be omitted and the intake manifold can be accurately located and sandwiched between the engine block 13 or other member and the carburetor unit 60 or individual carburetors 61.

When the carburetor unit 60 (or the individual carburetors 61) is secured directly to the engine block 13 by the illustrated bolts 85, as described, the intake manifold 41 is not a structural member and can therefore be desirably economically fabricated of a composite material, such as an alcohol-resistant plastic material.

Formed in the intake manifold 41 are conduit means 91 (FIG. 3) for supplying operating fuel to the carburetors 61, conduit means 93 (FIG. 2) for supplying primer fuel to the intake passages 51, 52 and 53, and drain recirculation conduit means 95 (FIG. 2) for delivering "drains " from the individual intake passages 51, 52 and 53 in which such "drains" accumulate to other ones of the intake passages 51, 52 and 53.

More specifically, while other constructions can be employed, in the disclosed construction, the operating fuel supply conduit means or system 91 comprises, in the carburetor mounting surface 45, (see FIG. 3) a like series of fuel supply recesses 106, 107 and 108 which respectively communicate with the carburetor fuel inlet ports 76 and (see FIG. 4) with a like series of internal fuel supply conduits or ducts 116, 117 and 118 which extend interiorly of the intake manifold 41 and terminate in the exterior surface 47.

Connected to the fuel supply ducts 116, 117 and 118 is an external header 121 including a like series of branch conduit portions 126, 127 and 128 which respectively communicate with the fuel supply conduits 116, 117 and 118 and with a common duct portion 129 which includes a fuel filter and which is adapted to be connected to a suitable source of operating fuel. As a result of the above arrangement, there are no hose connections downstream of the fuel filter which could allow debris to foul the carburetor jets.

While other constructions can be employed, in the disclosed construction the primer fuel supply means or system 93 comprises, in the carburetor mounting surface 45 (see FIG. 3), a like series of duct defining recesses or grooves 131, 132 and 133 which respectively extend from the circular openings 51*b*, 52*b* and 53*b* at the ends of the intake passages 51, 52 and 53, together with a like series of primer fuel cross bores 141, 142 and 143 (see FIGS. 2 and 3) extending interiorly of the intake manifold 41 between the mounting surfaces 43 and 45 and respectively communicating with the primer fuel duct defining recesses 131, 132 and 133. The ducts 131, 132 and 133 are sized to act as orifices to meter the amount of primer fuel which enters into the intake passages and thus into the crankcase.

In addition, the primer fuel supply means 93 includes (see FIG. 2) a duct defining recess 145 in the engine mounting surface 43 which communicates with each of the primer fuel bore cross bores 141, 142 and 143, together with another supply cross bore 147 (FIGS. 2 and 3) which extends internally of the manifold 41 and between the engine mounting surface 43 and the exterior surface 47, which communicates with the duct defining recess 145 in the area between the upper two intake passages 51 and 52 and which terminates in a primer fuel supply inlet in the exterior surface 47 of the intake manifold 41 between the upper two carburetors 61 and 62, and which is adapted to be suitably connected, as by a nipple or the like (not shown) to a suitable source of primer fuel. Any suitable means can be employed to cause primer fuel flow in the primer fuel supply system 93.

While other constructions can be employed, in the disclosed construction, the drains conduit means or system 95 for delivery or re-circulation of the "drains" comprises, in the engine mounting surface 43 (see FIG. 2), a like series of sumps 161, 162 and 163 respectively located below the lower ends of the rectangular openings 51*a*, 52*a* and 53*a* of the intake passages 51, 52 and 53, together with a like series of duct defining recesses 171, 172 and 173 located in the engine mounting surface 43 and respectively extending between the lower ends of the rectangular openings 51*a*, 52*a* and 53*a* and the sumps 161, 162 and 163.

Figure 3:
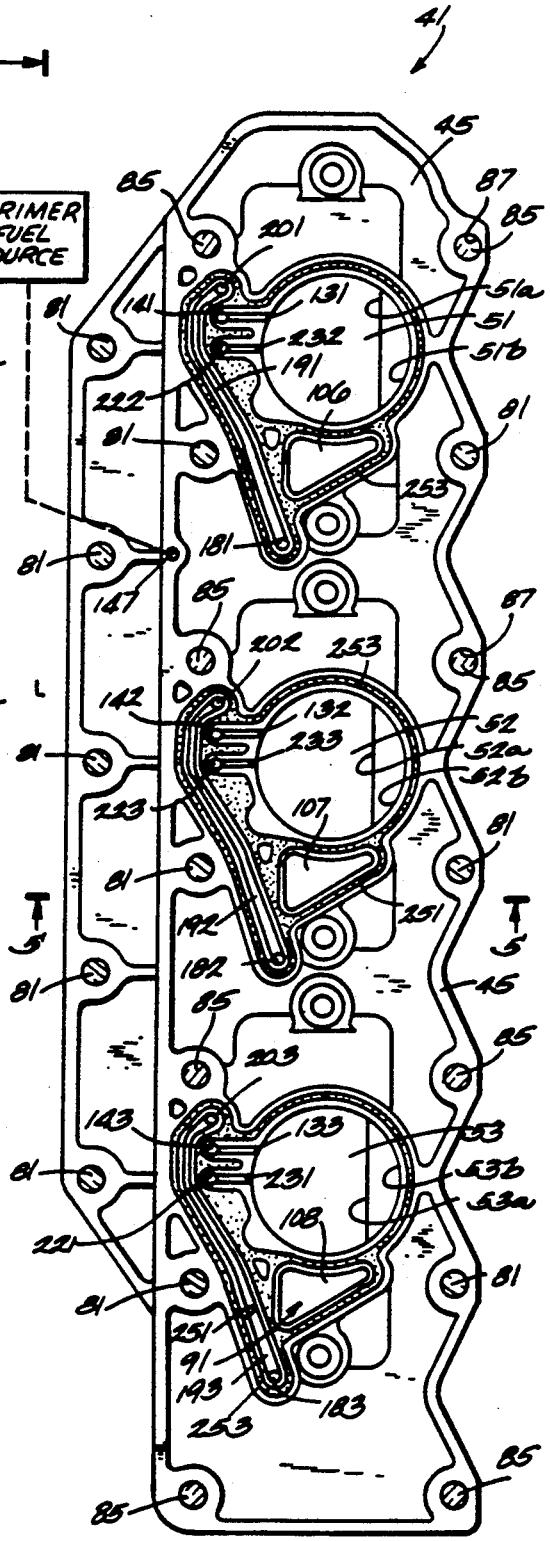
FIG. 3 is an enlarged and partially sectioned view of the opposite side (opposite to the side shown in FIG. 2) of the intake manifold incorporated in the engine shown in FIG. 1.
Figure 4:
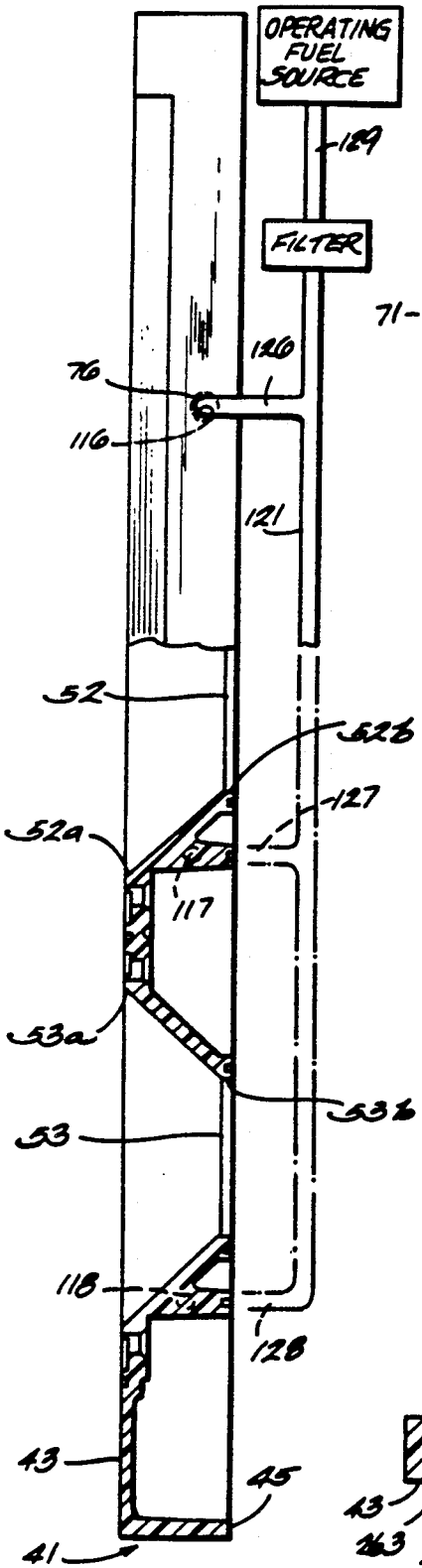
FIG. 4 is a sectional view taken along line 4—4 of FIG. 3.
Figure 1:
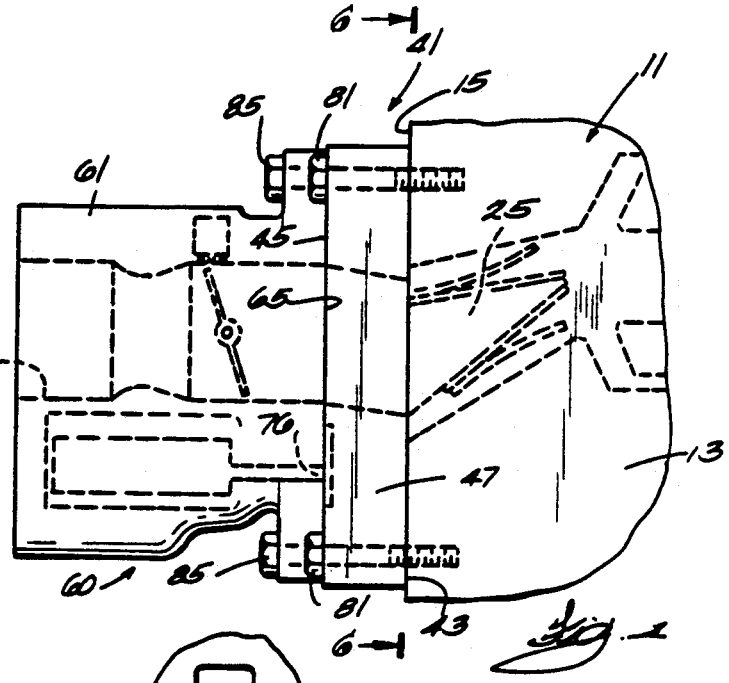
FIG. 1 is a fragmentary and partially schematic view of a two-stroke internal combustion engine embodying various of the features of the invention.
Figure 6:
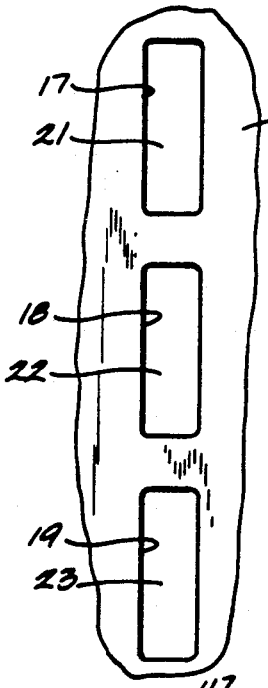
FIG. 6 is a fragmentary view, with parts omitted, taken along line 6—6 of FIG. 1.
Figure 5:
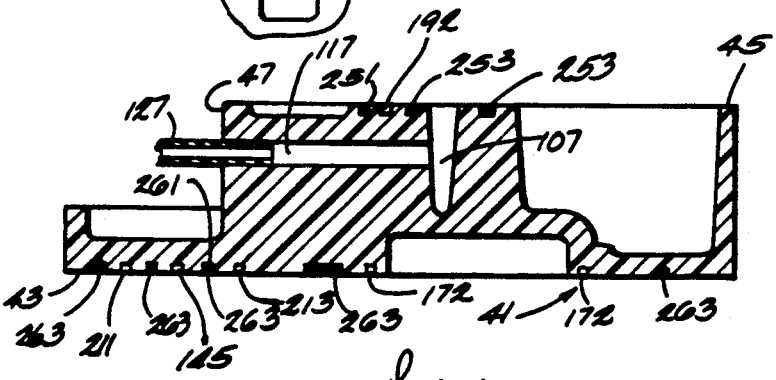
FIG. 5 is a sectional view taken along line 5—5 of FIG. 3.
Figure 8:
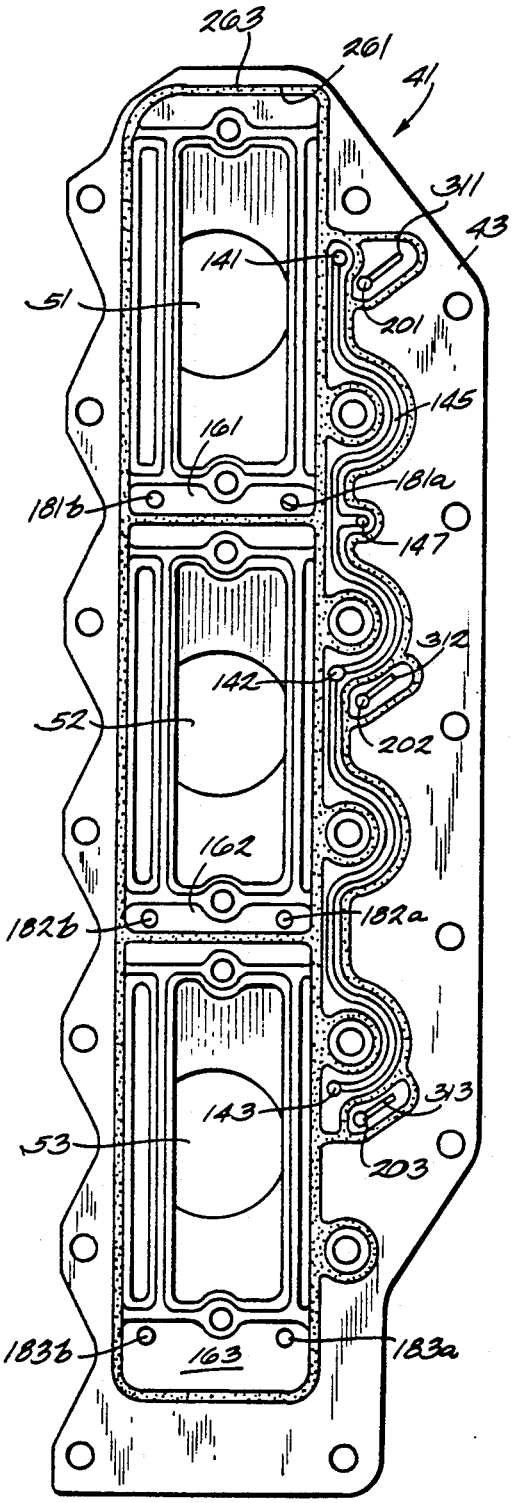
FIG. 8 is a view of one side of the intake manifold shown in FIG. 7.

The drains delivery means 95 also includes (see FIGS. 2 and 3) a first like series of drain cross bores 181, 182 and 183 which extend internally of the intake manifold 41 and between the mounting surfaces 43 and 45 and which respectively communicate with the sumps 161, 162 and 163. Each of the cross bores 181, 182 and 183 has therein a respective one-way valve 184 (FIG. 12) which permits fluid flow away from the associated one of the sumps 161, 162 and 163 or in the direction from the mounting surface 43 to the mounting surface 45. In addition, the drains delivery means 95 includes, in the carburetor mounting surface 45, (see FIG. 3) a like series of duct defining recesses 191, 192 and 193 which respectively communicate with the first series of cross bores 181, 182 and 183 and which extend upwardly in the carburetor mounting surface 45 and, as seen in FIG. 3, to the left of the adjacent circular openings 51*a*, 52*a*, and 53*a* and terminate in respective upper ends located slightly above and to the left of the associated intake passage 51, 52 and 53.

The drains delivery means 95 further includes (see FIGS. 2 and 3) a second like series of drain cross bores 201, 202 and 203 which extend interiorly of the intake manifold 41 between the mounting surfaces 43 and 45 and which respectively communicate with the upper ends of the duct defining recesses 191, 192 and 193 in the carburetor mounting surface 45.

The drains delivery means 95 further includes a like series of duct defining recesses 211, 212 and 213, respectively referred to as the connecting, upper, and lower recesses, which are located in the engine mounting surface 43 and which respectively extend from the second series of drain cross bores 201, 202 and 203. More specifically, the third or lower duct defining recess 213 extends upwardly from the lower cross bore 203 and in inwardly adjacent relation to the primer fuel recess 145 to a point located just below the central primer fuel cross bore 142.

The second or upper duct defining recess 212 extends upwardly from the central cross bore 202, at a point immediately above the central primer fuel cross bore 142, and in inwardly adjacent relation to the primer fuel recess 145 to a point immediately below the upper primer fuel cross bore 141.

The first or connecting duct defining recess 211 extends downwardly from the upper cross bore 201 from a point immediately above the upper primer fuel cross bore 141 and in outwardly adjacent relation to the primer fuel recess 145 to a point immediately below the lower primer fuel cross bore 143.

The drains delivery means 95 also includes (see FIGS. 2 and 3) a third like series of cross bores 221, 222 and 223 which extend interiorly of the intake manifold 41 and between the mounting surfaces 43 and 45 and respectively communicate with the duct defining recesses 211, 212 and 213. In addition, the drains delivering means 95 includes (see FIG. 3) a like series of duct defining recesses 231, 232 and 233 located in the carburetor mounting surface 45 and respectively communicating with the third series of cross bores 221, 222 and 223 and with the circular openings 51*b*, 52*b* and 53*b* at the intake passage ends in the carburetor mounting surface 45.

Means are also provided for preventing loss of fluid or pressure from the interface between the carburetor mounting surface 45 and the mounting surfaces of the carburetor unit 60 (or the individual carburetors 61). While other constructions can be employed, in the disclosed construction, the carburetor mounting surface 45 (see FIG. 3) is provided with a series of continuous recesses and grooves 251 which extend around the associate intake passage openings 51*b*, 52*b* and 53*b*, and which are slightly spaced from the fuel supply recesses 106, 107 and 108, from the fuel drain duct defining recesses 231, 232 and 233, and from the primer fuel supply recesses 131, 132, and 133. Located in each of the grooves 251 is a gasket 253 which is preferably fabricated of relatively soft rubber-like material and which is squeezed to provide an effective seal incident to fastening of the carburetor unit 60 (or individual carburetors 61) on the intake manifold 41.

Means are also provided for preventing loss of fluid or pressure at the interface between the engine mounting surface 43 and the manifold mounting face 15. While other constructions can be employed, in the disclosed construction, the engine mounting surface 43 is provided with a series of recesses and grooves 261 which are adjacent spacedly from and extend completely around the rectangular openings 51*a*, 52*a*, and 53*a*, to either side of and in adjacently spaced relation from the drains duct defining recesses 171, 172 and 173, around and in adjacently spaced relation to the drains sumps 161, 162 and 163, and around and in adjacently spaced relation to the primer fuel recess 145, and the drains recesses 211, 212, and 213. Located in the recesses and grooves 261 is a gasket 263 which is preferably of relatively soft rubber-like material and which is squeezed to provide an effective seal incident to attachment of the intake manifold 41 to the engine 11.

In operation, fuel entering from the header 121 flows through the interior ducts or conduits 126, 127, and 128 to the fuel supply recesses 106, 107 and 108 which communicate with the carburetor fuel inlets 45.

Primer fuel flows from the inlet cross bore 147 to the recess 145 in the engine mounting surface 43, then through the cross bores 141, 142 and 143, and then through the recesses 131, 132 and 133 in the carburetor mounting surface 45 to the circular openings 51*b*, 52*b* and 53*b* at the ends of the intake passages 51, 52 and 53 in the intake manifold 41.

Drains collecting in the lower intake passage 53 flow to the bottom sump 163 in the engine mounting surface 43, through the cross bore 183, up the duct defining recess 193 in the carburetor mounting surface 45, through the cross bore 203 to the duct defining recess 213 in the engine mounting surface 43, through the cross bore 223 to the duct defining recess 233 in the carburetor mounting surface 45, and to the circular opening 52*b* at the end of the central intake passage 52 in the intake manifold 41.

Drains collecting in the central intake passage 52 flow to the central sump 162 in the engine mounting surface 43, through the cross bore 182, up the duct defining recess 192 in the carburetor mounting surface 45, through the cross bore 202 to the duct defining recess 212 in the engine mounting surface 43, through the cross bore 222 to the duct defining recess 232 in the carburetor mounting surface 45, and to the circular opening 51*b* at the end of the upper intake passage 51 in the intake manifold 41.

Drains collecting in the upper intake passage 51 flow to the associated sump 161 in the engine mounting surface 43, through the cross bore 181, up the duct defining recess 191 in the carburetor mounting surface 45, through the cross bore 201 to the duct defining recess 211 in the engine mounting surface 43, downwardly through the duct defining recess 211 to the lower end thereof and through the cross bore 221 to the duct defining recess 231 in the carburetor mounting surface 45 to the circular opening 53*b* of the lower intake passage 53 in the intake manifold 41.

An internal combustion engine 300 that is an alternative embodiment of the invention is illustrated in FIGS. 7–11. Except as described hereinafter, the engine 300 is substantially identical to the engine 11 of the first embodiment, and common elements have been given the same reference numerals.

The engine 300 differs from the engine 11 in three main respects. First, the drain re-circulation conduit means 95 delivers "drains " to the boost port of an adjacent cylinder rather than to another one of the intake passages 51, 52 and 53. Second, the intake manifold 41 of the engine 300 does not include conduit means for supplying operating fuel to the carburetors 61. Instead, fuel is supplied directly to the carburetors 61 in a conventional manner. Third, the engine 300 includes (see FIGS. 7 and 9) a balance tube 304 that communicates with each of the intake passages 51, 52 and 53 in order to balance the intake manifold vacuum. Each of these features of the engine 300 is discussed in greater detail below.

Figure 9:
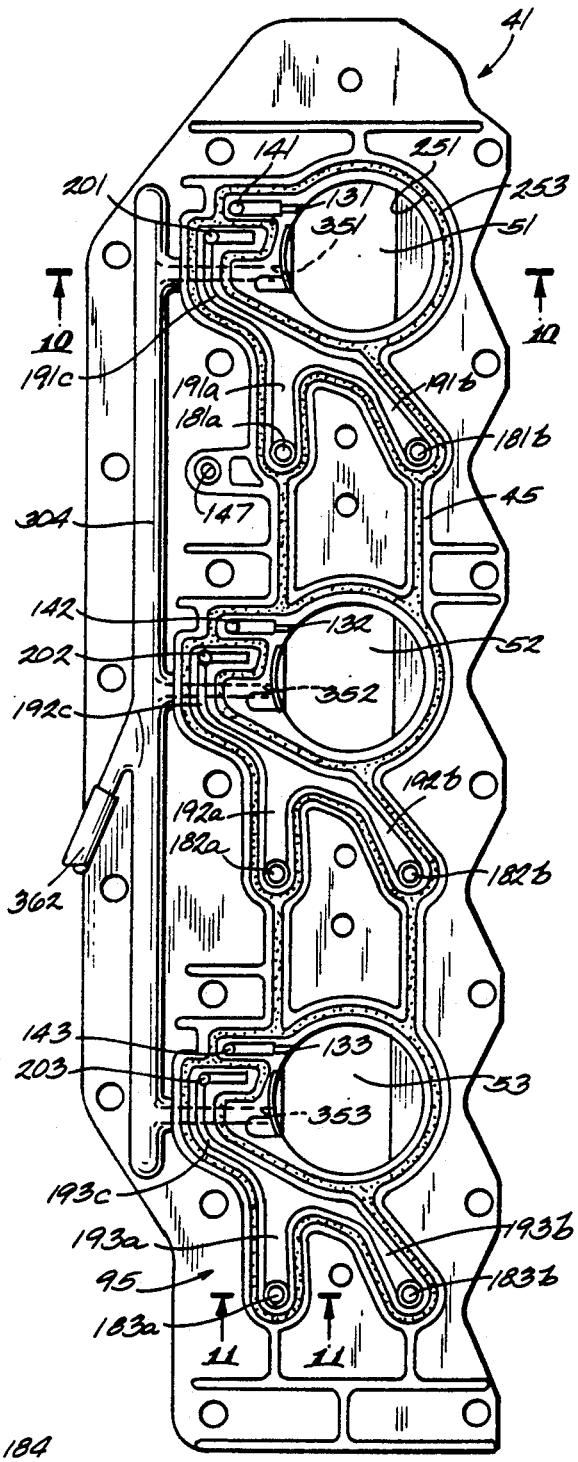
FIG. 9 is a view of the opposite side of the intake manifold shown in FIG. 7.
Figure 12:
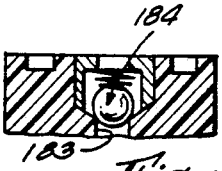
FIG. 12 is a view taken along line 12—12 in FIG. 2.

The drains delivery means 95 of the engine 300 includes (see FIG. 8) a pair of cross bores 181*a* and 181*b* communicating with the sump 161 and extending between the mounting surfaces 43 and 45, a pair of cross bores 182*a* and 182*b* communicating with the sump 162 and extending between the mounting surfaces 43 and 45, and a pair of cross bores 183*a* and 183*b* communicating with the sump 163 and extending between the mounting surfaces 43 and 45. Each of the cross bores 181*a*, 181*b*, 182*a*, 182*b*, 183*a* and 183*b* has therein a respective one way valve 184 (FIG. 11) which permits fluid flow away from the associated one of the sumps 161, 162 and 163 or in the direction from the mounting surface 43 to the mounting surface 45. In addition, the drains delivery means 95 includes (see FIG. 9), in the carburetor mounting surface 45, a pair of duct defining recesses 191*a* and 191*b* which respectively communicate with the cross bores 181*a* and 181*b* and which merge into a recess 191*c* having an upper end (as seen in FIG. 9) communicating with a drain cross bore 201 extending interiorly of the intake manifold 41 and between the mounting surfaces 43 and 45, a pair of duct defining recesses 192*a* and 192*b* which respectively communicate with the cross bores 182*a* and 182*b* and which merge into a recess 192*c* having an upper end communicating with a drain cross bore 202 extending interiorly of the intake manifold 41 and between the mounting surfaces 43 and 45, and a pair of duct defining recesses 193*a* and 193*b* which respectively communicate with the cross bores 183*a* and 183*b* and which merge into a recess 193*c* having an upper end communicating with a drain cross bore 203 extending interiorly of the intake manifold 41 and between the mounting surfaces 43 and 45.

The drains delivery means 95 further includes (see FIG. 8), in the engine mounting surface 43, a like series of duct defining recesses 311, 312 and 313 respectively communicating with the cross bores 201, 202 and 203 and each extending upwardly associated one of the cross bores 201, 202 and 203 and terminating in an upper end.

The drains delivery means 95 also includes (see FIG. 7) a like series of nipples 321, 322 and 323 mounted in the engine block 13 and respectively communicating with the upper ends of the recesses 311, 312 and 313, and a like series of nipples 331, 332 and 333 mounted in the engine block 13 and each communicating with the boost port 334 (shown schematically in FIG. 7) of a respective cylinder 336. The drains delivery means 95 further includes a flexible conduit or hose 341 communicating between the nipples 321 and 331, a flexible conduit or hose 342 communicating between the nipples 322 and 332, and a flexible conduit or hose 343 communicating between the nipples 323 and 333. In the illustrated construction, the hoses 341, 342 and 343 connect each of the intake passages 51, 52 and 53 with the boost port 334 of the engine cylinder 336 associated with a different one of the intake passages 51, 52 and 53.

The drains delivery system of the engine 300 permits "clean " hose routings. In other words, because the hoses 341, 342 and 343 are connected to the cylinder side of the intake manifold 41, the hoses are not routed around the intake manifold 41 to the carburetor side thereof. This simplifies engine assembly and repair.

Unlike the fuel delivery system of the engine 11, the fuel delivery system of the engine 300 includes (see FIG. 7) a conventional fuel rail 350 communicating between the operating fuel source and each of the carburetors 61.

In order to balance the vacuum in the intake passages 51, 52 and 53 of the intake manifold 41, the engine 300 further comprises (see FIGS. 9 and 10), in the intake manifold 41, a like series of internal conduits or ducts 351, 352 and 353 respectively communicating with the intake passages 51, 52 and 53 and each extending between the associated one of the intake passages 51, 52 and 53 and the exterior surface 47 of the intake manifold 41. The engine 300 further comprises (see FIGS. 7 and 9) a balance tube 304 communicating with each of the ducts 351, 352 and 353 so that each of the ducts 351, 352 and 353 communicates with the other two of the ducts 351, 352 and 353.

Preferably, the engine 300 is a V-6 engine having two such balance tubes 304, one for each cylinder bank, and the engine 300 further comprises a flexible hose or conduit 362 (one is shown in FIG. 9) communicating between one of the balance tubes 304 and the air silencer drain (not shown), and a flexible hose or conduit 362 communicating between the other one of the balance tubes 304 and the lower main bearing drain (not shown) The balance tubes 304 provide a relatively steady vacuum for pumping fuel and oil out of the air silencer drain and the lower main bearing drain.

Various of the features of the invention are set forth in the following claims.

We claim:

1. An internal combustion engine comprising an engine member including an intake manifold mounting face having therein a series of openings, an intake manifold including an engine mounting surface on said manifold mounting face, a carburetor mounting surface in spaced relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, and drains re-circulation means for delivering drains accumulating in said intake passages to intake passages other than said intake passages in which the drains accumulated, and a like series of carburetors on said carburetor mounting surface, said carburetors respectively including air induction passages communicating respectively with said openings in said carburetor mounting surface.

2. An internal combustion engine in accordance with claim 1 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces.

3. An internal combustion engine in accordance with claim 1 and further including means securing said carburetors to said engine member with said intake manifold captured between said engine member and said carburetors and including fasteners extending through said intake manifold and into said engine member.

4. An internal combustion engine in accordance with claim 1 wherein said intake manifold is fabricated of composite material.

5. An internal combustion engine comprising an engine member including an intake manifold mounting face having therein an opening, an intake manifold including an exterior surface comprising an engine mounting surface on said manifold mounting face, and a carburetor mounting surface in spaced relation to said engine mounting surface, an intake passage extending between said mounting surfaces, terminating at said engine mounting surface in an opening located in alignment with said opening in said manifold mounting face, and terminating at said carburetor mounting surface in an opening, and means for supplying primer fuel to said intake passage and comprising a primer fuel duct located in one of said mounting surfaces, and a carburetor located on said carburetor mounting surface and including an air induction passage communicating with said opening in said carburetor mounting surface.

6. An internal combustion engine in accordance with claim 5 wherein said primer fuel duct is located in said engine mounting surface, and wherein said primer fuel supply means also includes a primer fuel inlet located in said exterior surface and adapted to be connected to a source of primer fuel, a primer fuel duct located in said carburetor mounting surface and communicating with said opening in said carburetor mounting surface, and a cross bore extending between said mounting surfaces and communicating between said primer fuel duct in said carburetor mounting surface and said primer fuel duct in said engine mounting surface.

7. An internal combustion engine in accordance with claim 5 and further including means securing said carburetor to said engine member with said intake manifold captured between said engine member and said carburetor and including fasteners extending through said intake manifold and into said engine member.

8. An internal combustion engine in accordance with claim 5 wherein said intake manifold is fabricated of composite material.

9. An internal combustion engine comprising an engine member including an intake manifold mounting face having therein an opening, an intake manifold including an exterior surface comprising an engine mounting surface on said manifold mounting face, and a carburetor mounting surface in spaced relation to said engine mounting surface, an intake passage extending between said mounting surfaces, terminating at said engine mounting surface in an opening located in alignment with said opening in said manifold mounting face, and terminating at said carburetor mounting surface in an opening, and means for supplying operating fuel to a carburetor, and a carburetor located on said carburetor mounting surface and including an air induction passage communicating with said opening in said carburetor mounting surface and a fuel inlet port communicating with said operating fuel supply means in said intake manifold.

10. An internal combustion engine in accordance with claim 9 wherein said operating fuel supply means comprises a fuel supply recess located in said carburetor mounting surface and communicating with said fuel inlet port, and an internal duct communicating between said fuel supply recess and said exterior surface and adapted for communication with a fuel source.

11. An internal combustion engine in accordance with claim 9 and further including means securing said carburetor to said engine member with said intake manifold captured between said engine member and said carburetor and including fasteners extending through said intake manifold and into said engine member.

12. An internal combustion engine in accordance with claim 9 wherein said intake manifold is fabricated of composite material.

13. An internal combustion engine comprising an engine member including an intake manifold mounting face having therein a series of openings, an intake manifold including an exterior surface comprising an engine mounting surface on said manifold mounting face, and a carburetor mounting surface in spaced relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, drains re-circulation means for delivering drains accumulating in said intake passages to intake passages other than said intake passages in which the drains accumulated, and means for supplying primer fuel to said intake passages, and a like series of carburetors on said carburetor mounting surface, said carburetors respectively including air induction passages respectively communicating with said openings in said carburetor mounting surface.

14. An internal combustion engine in accordance with claim 13 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces, and wherein said primer fuel supply means comprises a primer fuel inlet located in said exterior surface and adapted to be connected to a source of primer fuel, a primer fuel duct located in said engine mounting surface and communicating with said primer fuel inlet, a like series of primer fuel ducts located in said carburetor mounting surface and respectively communicating with said openings in said carburetor mounting surface, and a like series of cross bores extending between said mounting surfaces and respectively communicating between said primer fuel duct in said carburetor mounting surface and said primer fuel ducts in said engine mounting surfaces.

15. An internal combustion engine in accordance with claim 13 and further including means securing said carburetors to said engine member with said intake manifold captured between said engine member and said carburetors and including fasteners extending through said intake manifold and into said engine member.

16. An internal combustion engine in accordance with claim 13 wherein said intake manifold is fabricated of composite material.

17. An internal combustion engine comprising an engine member including an intake manifold mounting face having therein a series of openings, an intake manifold including an exterior surface comprising an engine mounting surface on said manifold mounting face, and a carburetor mounting surface in spaced relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, drains re-circulation means for delivering drains accumulating in said intake passages to intake passages other than said intake passages in which the drains accumulated, and means for supplying operating fuel to a like series of carburetors, and a like series of carburetors on said carburetor mounting surface, said carburetors including respective air induction passages respectively communicating with said openings in said carburetor mounting surface and respective fuel inlet ports respectively communicating with said operating fuel supply means in said intake manifold.

18. An internal combustion engine in accordance with claim 17 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces, and wherein said operating fuel supply means comprises a like series of fuel supply recesses located in said carburetor mounting surface and respectively communicating with said fuel inlet ports, and a series of internal ducts respectively communicating between said fuel supply recesses and said exterior surface and adapted for communication with a source of operating fuel.

19. An internal combustion engine in accordance with claim 17 and further including means securing said carburetors to said engine member with said intake manifold captured between said engine member and said carburetors and including fasteners extending through said intake manifold and into said engine member.

20. An internal combustion engine in accordance with claim 17 wherein said intake manifold is fabricated of composite material.

21. An internal combustion engine comprising an engine member including an intake manifold mounting face having therein a series of openings, an intake manifold including an exterior surface comprising an engine mounting surface on said manifold mounting face, and a carburetor mounting surface in spaced relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, drains re-circulation means for delivering drains accumulating in said intake passages to intake passages other than said intake passages in which the drains accumulated, means for supplying primer fuel to said intake passages, and means for supplying operating fuel to a like series of carburetors, and a like series of carburetors on said carburetor mounting surface, said carburetors including respective air induction passages respectively communicating with said openings in said carburetor mounting surface, and respective fuel inlet ports respectively communicating with said operating fuel supply means in said intake manifold.

22. An internal combustion engine in accordance with claim 21 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces, wherein said primer fuel supply means comprises a primer fuel inlet located in said exterior surface and adapted to be connected to a source of primer fuel, a like series of primer fuel ducts located in said carburetor mounting surface and communicating with said openings in said carburetor mounting surface, a primer fuel duct located in said engine mounting surface and communicating with said primer fuel inlet, and a like series of cross bores extending between said mounting surfaces and respectively communicating with said primer fuel ducts in said carburetor mounting surface and with said primer fuel duct in said engine mounting surface, and wherein said operating fuel supply means comprises a like series of fuel supply recesses located in said carburetor mounting surface and respectively communicating with said fuel inlet ports, and a series of internal ducts respectively communicating between said fuel supply recesses and said exterior surface and adapted for communication with a source of operating fuel.

23. An internal combustion engine in accordance with claim 21 and further including means securing said carburetors to said engine member with said intake manifold captured between said engine member and said carburetors and including fasteners extending through said intake manifold and into said engine member.

24. An internal combustion engine in accordance with claim 21 wherein said intake manifold is fabricated of composite material.

25. An internal combustion engine comprising an engine block including an intake manifold mounting face having therein a series of rectangular openings, an intake manifold including an exterior surface comprising an engine mounting surface on said intake manifold mounting face, and a carburetor mounting surface in spaced parallel relation to said engine mounting surface, a like series of intake passages extending between said mounting surfaces, terminating at said engine mounting surface in respective rectangular openings respectively located in alignment with said openings in said manifold mounting face and having respective lower ends, and terminating at said carburetor mounting surface with respective circular openings, means for supplying operating fuel and including a like series of fuel supply recesses located in said carburetor mounting surface, and a like series of fuel supply conduits respectively communicating between said fuel supply recesses and said exterior surface, means for supplying primer fuel and comprising a primer fuel inlet port located in said exterior surface and adapted to communicate with a source of primer fuel, a common recess located in said engine mounting surface and communicating with said primer fuel inlet port, a like series of primer fuel cross bores extending between said mounting surfaces and communicating with said common recess, and a like series of duct defining recesses located in said carburetor mounting surface and respectively communicating with said primer fuel cross bores and with said openings in said carburetor mounting surface, and drains re-circulation means comprising a like series of sump defining recesses in said engine mounting surface, a like series of duct defining recesses located in said engine mounting surface and respectively communicating between said sump defining recesses and said lower ends of said openings in said engine block mounting surface, a first like series of cross bores extending between said mounting surfaces and respectively communicating with said series of sump defining recesses, a first like series of duct defining recesses in said carburetor mounting surface and respectively communicating with said first series of cross bores, a second like series of cross bores extending between said mounting surfaces and respectively communicating with said first like series of duct defining recesses in said carburetor mounting surface, a second like series of duct defining recesses extending in said engine mounting surface and respectively communicating with said second like series of cross bores, a third like series of cross bores extending between said mounting surfaces and respectively communicating with said second like series of duct defining recesses in said engine mounting surface, and a second like series of duct defining recesses in said carburetor mounting surface and respectively communicating between said third like series cf cross bores and said circular openings in said carburetor mounting surface, an operating fuel supply header exterior to said intake manifold and including a like series of branch conduit portions respectively communicating with said fuel supply conduits, and a common portion communicating with said branch portions and having therein a fuel filter and being adapted to communicate with a source of operating fuel, a like series of carburetors located on said carburetor mounting surface and including respective air induction passages respectively located in communication with said circular openings in said carburetor mounting surface, and respective fuel inlet ports respectively located in communication with said fuel supply recesses, means fastening said intake manifold to said engine block, and means securing said carburetors on said intake manifold including fasteners extending through said intake manifold and into said engine block.

26. An internal combustion engine in accordance with claim 25 wherein said intake manifold is fabricated of composite material.

27. An intake manifold including an engine mounting surface, a carburetor mounting surface in spaced relation to said engine mounting surface, a series of intake passages extending between said mounting surfaces, terminating at said engine mounting surface in respective openings and terminating at said carburetor mounting surface in respective openings, and drains re-circulation means for delivering drains accumulating in said intake passages to intake passages other than said intake passages in which the drains accumulated.

28. An intake manifold in accordance with claim 27 wherein said recirculation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces.

29. An intake manifold in accordance with claim 27 wherein said intake manifold is fabricated of composite material.

30. An intake manifold including an exterior surface comprising an engine mounting surface, and a carburetor mounting surface in spaced relation to said engine mounting surface, an intake passage extending between said mounting surfaces, terminating at said engine mounting surface in an opening, and terminating at said carburetor mounting surface in an opening, and means for supplying primer fuel to said intake passage and comprising a primer fuel duct located in one of said mounting surfaces.

31. An intake manifold in accordance with claim 30 wherein said said primer fuel duct is located in said engine mounting surface, and wherein said primer fuel supply means further comprises a primer fuel inlet located in said exterior surface and adapted to be connected to a source of primer fuel, and another primer fuel duct located in said carburetor mounting surface and communicating with said opening in said carburetor mounting surface, and a cross bore extending between said mounting surfaces and communicating between said primer fuel duct in said carburetor mounting surface and said primer fuel duct in said engine mounting surface.

32. An intake manifold in accordance with claim 30 wherein said intake manifold is fabricated of composite material.

33. An intake manifold including an exterior surface comprising an engine mounting surface, and a carburetor mounting surface in spaced relation to said engine mounting surface, an intake passage extending between said mounting surfaces, terminating at said engine mounting surface in an opening, and terminating at said carburetor mounting surface in an opening, and means in said manifold for supplying operating fuel to a carburetor.

34. An intake manifold in accordance with claim 33 wherein said operating fuel supply means comprises a fuel supply recess located in said carburetor mounting surface and adapted to supply fuel to the carburetor, and an internal duct communicating between said fuel supply recess and said exterior surface and adapted for communication with a source of operating fuel.

35. An intake manifold in accordance with claim 33 wherein said intake manifold is fabricated of composite material.

36. An intake manifold including an exterior surface comprising an engine mounting surface, and a carburetor mounting surface in spaced relation to said engine mounting surface, a series of intake passages extending between said mounting surfaces, terminating at said engine mounting surface in respective openings, and terminating at said carburetor mounting surface in respective openings, drains re circulation means for delivering drains accumulating in said intake passages to intake passages other than said intake passages in which the drains accumulated, and means for supplying primer fuel to said intake passages.

37. An intake manifold in accordance with claim 36 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces, and wherein said primer fuel supply means comprises a primer fuel inlet located in said exterior surface and adapted to be connected to a source of primer fuel, a primer fuel duct located in said engine mounting surface and communicating with said primer fuel inlet, a like series of primer fuel ducts located in said carburetor mounting surface and respectively communicating with said openings in said carburetor mounting surface, and a like series of cross bores extending between said mounting surfaces and respectively communicating between said primer fuel ducts in said carburetor mounting surface and said primer fuel duct in said engine mounting surface.

38. An intake manifold in accordance with claim 36 wherein said intake manifold is fabricated of composite material.

39. An intake manifold including an exterior surface comprising an engine mounting surface, and a carburetor mounting surface in spaced relation to said engine mounting surface, a series of intake passages extending between said mounting surfaces, terminating at said engine mounting surface in respective openings, and terminating at said carburetor mounting surface in respective openings, drains re-circulation means for delivering drains accumulating in said intake passages to intake passages other than said intake passages in which the drains accumulated, and means for supplying operating fuel to a like series of carburetors.

40. An intake manifold in accordance with claim 39 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces, and wherein said operating fuel supply means comprises a like series of fuel supply recesses located in said carburetor mounting surface and respectively adapted to supply fuel to the carburetors, and a like series of internal ducts respectively communicating between said fuel supply recesses and said exterior surface and adapted for communication with a fuel source.

41. An intake manifold in accordance with claim 39 wherein said intake manifold is fabricated of composite material.

42. An intake manifold including an exterior surface comprising an engine mounting surface, and a carburetor mounting surface in spaced relation to said engine mounting surface, a series of intake passages extending between said mounting surfaces, terminating at said engine mounting surface in respective openings, and terminating at said carburetor mounting surface in respective openings, drains re-circulation means for delivering drains accumulating in said intake passages to intake passages other than said intake passages in which the drains accumulated, means for supplying primer fuel to said intake passages, and means for supplying operating fuel to a like series of carburetors.

43. An intake manifold in accordance with claim 42 wherein said drains re-circulation means comprises a like series of drain ducts located in said engine mounting surface and respectively communicating with said openings in said engine mounting surface for draining drains from said intake passages, a like series of drain ducts located in said carburetor mounting surface and respectively communicating with said openings in said carburetor mounting surface for delivering drains to said intake passages, and a like series of cross bores extending between said mounting surfaces and respectively communicating with said drain ducts in said mounting surfaces, wherein said primer fuel supply means comprises a primer fuel inlet located in said exterior surface and adapted to be connected to a source of primer fuel, a primer fuel duct located in said engine mounting surface and communicating with said primer fuel inlet, a like series of primer fuel ducts located in said carburetor mounting surface and respectively communicating with said openings in said carburetor mounting surface, and a like series of cross bores extending between said mounting surfaces and respectively communicating between said primer fuel ducts in said carburetor mounting surface and said primer fuel duct in said engine mounting surface, and wherein said operating fuel supply means comprises a like series of fuel supply recess located in said carburetor mounting surface and respectively adapted to supply fuel to the carburetors, and a like series of internal ducts respectively communicating between said fuel supply recesses and said exterior surface and adapted for communication with a fuel source.

44. An intake manifold in accordance with claim 42 wherein said intake manifold is fabricated of composite material.

45. An internal combustion engine comprising an engine member including an intake manifold mounting face, an intake manifold including an engine mounting surface on said manifold mounting face, and a carburetor mounting surface in spaced parallel relation to said engine mounting surface, a carburetor on said carburetor mounting surface, one of said manifold mounting surfaces including therein a recess adapted for conveying a fluid, and means securing said carburetor to said engine member with said intake manifold captured between said engine member and said carburetor and including fasteners extending through said intake manifold and into said engine member.

46. An internal combustion engine comprising an engine member including an intake manifold mounting face having therein a series of openings, an intake manifold including an engine mounting surface on said manifold mounting face, a carburetor mounting surface in spaced parallel relation to said engine mounting surface, and a like series of intake passages extending between said mounting surfaces, terminating at said engine mounting surface in respective openings respectively located in alignment with said openings in said manifold mounting face, and terminating at said carburetor mounting surface in respective openings, said intake manifold further including drains re-circulation means for delivering drains accumulating in said intake passages to intake passages other than said intake passages in which the drains accumulated, a carburetor on said carburetor mounting surface, and means securing said carburetor to said engine member with said intake manifold captured between said engine member and said carburetor and including fasteners extending through said intake manifold and into said engine member.

47. An internal combustion engine in accordance with claim 46 wherein said drains re-circulation means includes a least one duct in one of said mounting surfaces.

48. An internal combustion engine comprising an engine member including an intake manifold mounting face having therein an opening, an intake manifold including an engine mounting surface on said manifold mounting face, a carburetor mounting surface in spaced parallel relation to said engine mounting surface, an intake passage extending between said mounting surfaces, terminating at said engine mounting surface in a opening located in alignment with said opening in said manifold mounting face, and terminating at said carburetor mounting surface in an opening, and means for supplying primer fuel to said intake passage, a carburetor on said carburetor mounting surface, and means securing said carburetor to said engine member with said intake manifold captured between said engine member and said carburetor and including fasteners extending through said intake manifold and into said engine member.

49. An internal combustion engine in accordance with claim 48 wherein said means for supplying primer fuel includes at least one duct in one of said mounting surfaces.

50. An internal combustion engine in accordance with claim 45 wherein said intake manifold mounting face includes therein an opening, wherein said intake manifold includes an intake passage extending between said mounting surfaces, terminating at said engine mounting surface in an opening located in alignment with said opening in said manifold mounting face, and terminating at said carburetor mounting surface in an opening, said intake manifold further including means for supplying operating fuel to a carburetor on said carburetor mounting surface.

51. An internal combustion engine comprising an engine member including an intake manifold mounting face having therein an opening, an intake manifold including an engine mounting surface on said manifold mounting face, a carburetor mounting surface in spaced parallel relation to said engine mounting surface, an intake passage extending between said mounting surfaces, terminating at said engine mounting surface in an opening located in alignment with said opening in said manifold mounting face, and terminating at said carburetor mounting surface in an opening, and means for supplying operating fuel to a carburetor on said carburetor mounting surface, said operating fuel supply means including a recess in said carburetor mounting surface, a carburetor on said carburetor mounting surface, and means securing said carburetor to said engine member with said intake manifold captured between said engine member and said carburetor and including fasteners extending through said intake manifold and into said engine member.

52. An internal combustion engine comprising an engine member including an intake manifold mounting face having therein a series of openings, an intake manifold including an engine mounting surface on said manifold mounting face, a carburetor mounting surface in spaced parallel relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, drains re-circulation means for delivering drains accumulating in said intake passages to intake passages other than said intake passages in which the drains accumulated, and means for supplying primer fuel to said intake passages, a carburetor on said carburetor mounting surface, and means securing said carburetor to said engine member with said intake manifold captured between said engine member and said carburetor and including fasteners extending through said intake manifold and into said engine member.

53. An internal combustion engine in accordance with claim 52 wherein said drains re-circulation means and said means for supplying primer fuel each includes at least one duct in one of said mounting surfaces.

54. An internal combustion engine comprising an engine member including an intake manifold mounting face having therein a series of openings, an intake manifold including an engine mounting surface on said manifold mounting face, a carburetor mounting surface in spaced parallel relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, drains re-circulation means for delivering drains accumulating in said intake passages to intake passages other than said intake passages in which the drains accumulated, and means for supplying operating fuel to a like series of carburetors on said carburetor mounting surface, a like series of carburetors on said carburetor mounting surface, and means securing said carburetors to said engine member with said intake manifold captured between said engine member and said carburetors and including fasteners extending through said intake manifold and into said engine member.

55. An internal combustion engine in accordance with claim 54 wherein said drains re-circulation means includes at least one duct in one of said mounting surfaces and wherein said operating fuel supply means includes a like series of recesses in said carburetor mounting surface.

56. An internal combustion engine comprising an engine member including an intake manifold mounting face having therein a series of openings, an intake manifold including an engine mounting surface on said manifold mounting face, a carburetor mounting surface in spaced parallel relation to said engine mounting surface, a like series of intake passages extending between said mounting surfaces, terminating at said engine mounting surface in respective openings respectively located in alignment with said openings in said manifold mounting face, and terminating at said carburetor mounting surface in respective openings, drains re-circulation means for delivering drains accumulating in said intake passages to intake passages other than said intake passages in which the drains accumulated, means for supplying primer fuel to said intake passages, and means for supplying operating fuel to a like series of carburetors on said carburetor mounting surface, a like series of carburetors on said carburetor mounting surface, and means securing said carburetors to said engine member with said intake manifold captured between said engine member and said carburetors and including fasteners extending through said intake manifold and into said engine member.

57. An internal combustion engine in accordance with claim 56 wherein said drains re-circulation means and said means for supplying primer fuel each includes a least one duct in one of said mounting surfaces, and wherein said operating fuel supply means includes a like series of recesses in said carburetor mounting surface.

58. An internal combustion engine in accordance with claim 45 wherein said intake manifold is fabricated of composite material.

59. An internal combustion engine in accordance with claim 45 wherein said mounting surfaces are each planar.

60. An intake manifold including an engine mounting surface, a carburetor mounting surface in spaced relation to said engine mounting surface, an intake passage extending between said mounting surfaces, terminating at said engine mounting surface in an opening and terminating at said carburetor mounting surface in an opening, and means for draining drains accumulating in said intake passage, said means comprising a drain duct in said carburetor mounting surface, and a cross bore extending between said mounting surfaces and communicating between said opening in said engine mounting surface and said drain duct.

61. An intake manifold as set forth in claim 60 wherein said means also comprises a sump communicating with said opening in said engine mounting surface, and wherein said cross bore communicates with said sump.

62. An intake manifold as set forth in claim 60 wherein said means also comprises a drain duct in said engine mounting surface, and a second cross bore extending between said mounting surfaces and communicating between said drain duct in said carburetor mounting surface and said drain duct in said engine mounting surface.

63. An intake manifold as set forth in claim 60 wherein said means also comprises a second cross bore extending between said mounting surfaces and communicating between said opening in said engine mounting surface and said drain duct.

64. An intake manifold as set forth in claim 63 wherein said means also comprises a sump communicating with said opening in said engine mounting surface, and wherein said cross bores communicate with said sump.

65. An internal combustion engine comprising an engine block including an intake manifold mounting surface and defining a cylinder and a transfer passage communicating with said cylinder, an intake manifold including an engine mounting surface mating with said intake manifold mounting surface, a carburetor mounting surface in spaced relation to said engine mounting surface, an intake passage extending between said engine mounting surface and said carburetor mounting surface, terminating at said engine mounting surface in an opening communicating with said transfer passage, and terminating at said carburetor mounting surface in an opening, and drains recirculation means comprising a drain duct located in said engine mounting surface and communicating with said opening in said engine mounting surface, and means for delivering drains from said drain duct to said transfer passage.

66. An engine as set forth in claim 65 wherein said means for deliverying drains from said drain duct to said transfer passage includes a flexible conduit.

* * * * *